US007359289B2

(12) United States Patent
Saunier

(10) Patent No.: US 7,359,289 B2
(45) Date of Patent: Apr. 15, 2008

(54) WATCH PROVIDED WITH PUSH-BUTTONS COMPRISING A MECHANISM FOR ACTUATING DELOCALISED CONTROL ELEMENTS OF A CLOCKWORK

(75) Inventor: André Saunier, Courgenay (CH)

(73) Assignee: Tissot S.A., Le Locle (CH)

( * ) Notice: Subject to any disclaimer, the term of this patent is extended or adjusted under 35 U.S.C. 154(b) by 85 days.

(21) Appl. No.: 10/597,055

(22) PCT Filed: Dec. 21, 2004

(86) PCT No.: PCT/EP2004/014518

§ 371 (c)(1),
(2), (4) Date: Jul. 10, 2006

(87) PCT Pub. No.: WO2005/066725

PCT Pub. Date: Jul. 21, 2005

(65) Prior Publication Data

US 2007/0153640 A1 Jul. 5, 2007

(30) Foreign Application Priority Data

Jan. 9, 2004 (EP) ..... 04000326

(51) Int. Cl.
*G04B 19/06* (2006.01)

(52) U.S. Cl. ..... 368/229; 368/88

(58) Field of Classification Search ..... 368/62, 368/153, 301, 308–309, 315, 96, 110, 313, 368/319–321, 88, 229, 232, 236
See application file for complete search history.

(56) References Cited

U.S. PATENT DOCUMENTS 2,004,280 A 6/1935 Handley (Continued)

FOREIGN PATENT DOCUMENTS

CH 661 404 G A3 7/1987

(Continued)

OTHER PUBLICATIONS

International Search Report issued in corresponding application No. PCT/EP2004/014518 completed Apr. 7, 2005 and mailed Apr. 15, 2005.

*Primary Examiner*—P. Austin Bradley
*Assistant Examiner*—Sean Kayes
(74) *Attorney, Agent, or Firm*—Griffin & Szipi, P.C.

(57) ABSTRACT

The invention concerns a watch including a case having a middle part and housing a watch movement having a time-setting stem in a first peripheral region, said movement further including a first and a second control member which are arranged on either side of the time-setting stem and which each have an angular shift of less than 90° with the time-setting stem in relation to the centre of the movement, the watch further including an actuation device including a first and a second push-button arranged on the case in proximity to the movement, for respectively actuating said first and second control members, said watch being characterized in that, between each of said first and second push-buttons and said time-setting stem, there is an angular shift greater than 90° in relation to the centre of the movement, in that said first and second push-buttons are arranged in a second peripheral region of said watch movement, in that said actuation device further includes a transmission mechanism extending between said first push-button and said first control member, on the one hand, and between said second push-button and said second control member on the other hand, and in that said transmission mechanism is independent of said watch movement.

11 Claims, 2 Drawing Sheets

U.S. PATENT DOCUMENTS

| | | | | | |
|---|---|---|---|---|---|
| 2,456,122 | A | * | 12/1948 | Guilden | 368/27 |
| 3,633,354 | A | * | 1/1972 | Stemmler | 368/27 |
| 3,759,033 | A | * | 9/1973 | Jeanmonod | 368/101 |
| 4,364,674 | A | * | 12/1982 | Tesch | 368/319 |
| 4,396,296 | A | * | 8/1983 | Stodden | 368/101 |
| 4,623,261 | A | * | 11/1986 | Muto | 368/80 |
| 6,247,841 | B1 | | 6/2001 | Erard | |

FOREIGN PATENT DOCUMENTS

| | | |
|---|---|---|
| DE | 41 39 902 A1 | 5/1992 |
| FR | 1.041.359 | 10/1953 |

* cited by examiner

WATCH PROVIDED WITH PUSH-BUTTONS COMPRISING A MECHANISM FOR ACTUATING DELOCALISED CONTROL ELEMENTS OF A CLOCKWORK

This is a National Phase Application in the United States of International Patent Application No. PCT/EP2004/014518 filed Dec. 21, 2004, which claims priority on European Patent Application No. 04000326.1, filed Jan. 9, 2004 The entire disclosures of the above patent applications are hereby incorporated by reference.

FIELD OF THE INVENTION

The present invention concerns a watch fitted with push-buttons including a mechanism for actuating control members of a timepiece movement which are delocalised in relation to the push-buttons. More specifically, the invention concerns a watch of this type including a chronograph type timepiece movement, wherein the time-setting stem and the chronograph function control members are arranged on the same side of the movement, typically at 9 o'clock for the time-setting stem, and at 8 o'clock and 10 o'clock for the control members and wherein the two chronograph function control push-buttons are respectively arranged at 2 o'clock and 4 o'clock.

BACKGROUND OF THE INVENTION

There is already known a watch including chronograph type watch movement including a scale of 12 hours on its dial and wherein, for aesthetic reasons, the time-setting stem and associated crown are arranged at 9 o'clock, whereas the chronograph function control push-buttons are respectively arranged at 2 o'clock and 4 o'clock. A watch answering this description is for example marketed by the Tag Heuer company under the name of Autovia. A chronograph watch including a similar arrangement of the crown and chronograph function push-buttons is also disclosed in CH Patent No. 661 404. In order to achieve this original configuration of the crown and control push-buttons, these watches are fitted with dedicated complex mechanical watch movements, wherein the chronograph function control members, which are conventionally arranged on either side of the time-setting stem, are provided at the moment of conception, directly opposite the push-buttons with which they are associated. In order to obtain this configuration of the crown and push-buttons in a chronograph watch, dedicated movements must thus be used, whose cost is prohibitive if one wishes to propose such watches to consumers at an attractive price.

It is therefore a main object of the invention to overcome the drawbacks of the aforementioned prior art by providing a watch, particularly a chronograph, wherein the crown and the push-buttons are respectively arranged on opposite sides of the movement using simple, reliable and inexpensive design means.

It is also an object of the invention to provide a watch including this geometrical arrangement of the crown and push-buttons around the case able to use any conventional mechanical or electronic chronograph movement.

SUMMARY OF THE INVENTION

The invention therefore concerns a watch including a case having a middle part and housing a watch movement having, in a first peripheral regions, a time-setting stem, said movement further including a first and a second control member which are arranged on either side of the time-setting stem and which each have an angular shift of less than 90° with the time-setting stem in relation to the centre of the movement, the watch further including an actuation device including a first and a second push-button arranged on the case in proximity to the movement, for respectively actuating said first and second control members, said watch being characterized in that, between each of said first and second push-buttons and said time-setting stem, there is an angular shift greater than 90° in relation to the centre of the movement, in that said first and second push-buttons are arranged in a second peripheral region of said watch movement, in that said activation device further includes a transmission mechanism extending between said first push-button and said first control member, on the one hand, and between said second push-button and said second control member on the other hand, and in that said transmission mechanism is independent of said watch movement.

This structure has the advantage of enabling watches to be made wherein the crown and the push-buttons are respectively arranged on opposite sides of the watchcase without having to use movements dedicated to the desired arrangement of the crown and push-buttons.

According to a preferred embodiment of the invention, the transmission mechanism is carried by the casing ring inserted between the case and the movement.

BRIEF DESCRIPTION OF THE DRAWINGS

Other features and advantages of the invention will appear upon reading the description of an example embodiment, given by way of non-limiting illustration, with reference to the annexed drawings, in which.

DETAILED DESCRIPTION OF THE ILLUSTRATIVE EMBODIMENTS

Figure 1:
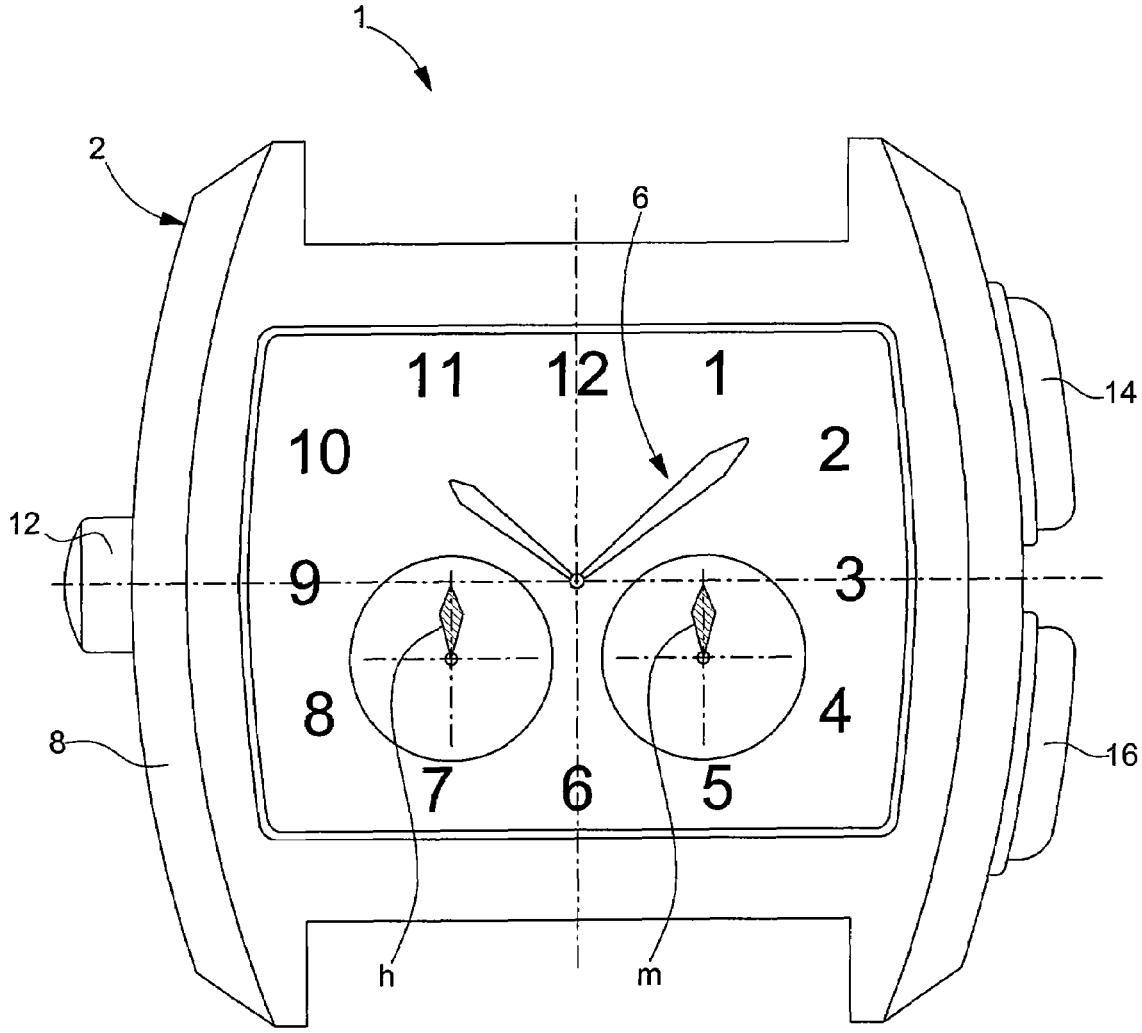
FIG. 1 is a top view of a watch according to the invention.
Figure 2:
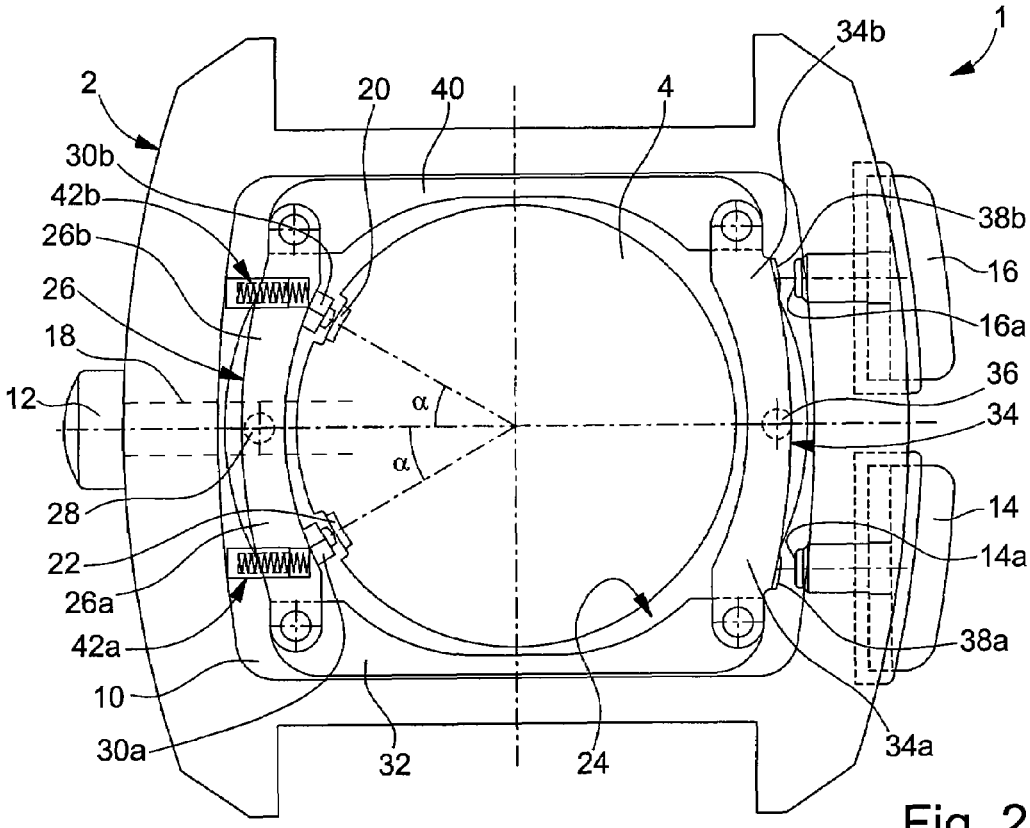
FIG. 2 is a bottom view of a watch according to the invention, in which the back cover of the case has been omitted, the watch being shown in a rest position.
Figure 3:
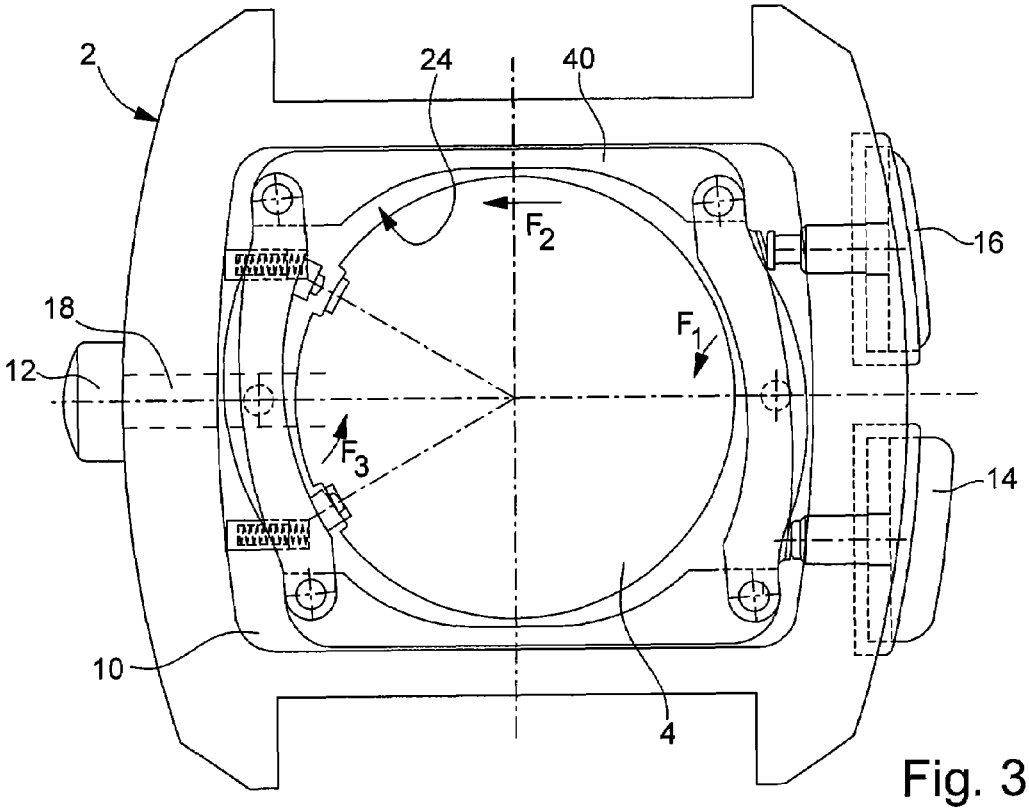
FIG. 3 is a similar view to FIG. 2, the watch being shown in a position in which one of the push-buttons is actuated.

FIGS. 1 to 3 show an embodiment of a watch according to the invention, generally designated by the reference numeral 1. In the example shown, watch 1 includes a case 2 enclosing a watch movement 4 (FIGS. 2 and 3) fitted with a chronograph mechanism, time display means 6, including in this case hands and a dial graduated over 12 hours and chronograph indicators for displaying a period of time, in this case a first small hand m for counting the minutes and a second small hand h for counting the hours. Movement 4 may be a manually or automatically wound mechanical movement or an electronic movement, for example quartz, powered by a battery. Case 2 includes, in a conventional manner, a middle part 8, a crystal and a back cover (not shown) and a casing ring 10 inserted between the middle part and the movement and via which movement 4 is mounted in the case.

Watch 1 is fitted with a crown 12 arranged at 9 o'clock and two push-buttons 14 and 16, respectively at 2 o'clock and 4 o'clock, accessible from outside case 2, crown 12 and the two push-buttons 14 and 16 being conventionally arranged in proximity to the movement. Crown 12 is able to act on a time-setting stem 18 also arranged at 9 o'clock, whereas push-buttons 14 and 16 are able to act respectively on first and second control members 20, 22, respectively arranged at 8 o'clock and 10 o'clock. Depending upon the type of movement used, the first and second control members 20 and 22 may either be simple fixed or mobile electric contact strips, or an operation start mechanism, for example a lever. The first control member 20, which is controlled by push-button 14, starts and stops the chronograph mechanism, the second control member 22, which is controlled by push-button 16, resets the chronograph display to zero, and time-setting stem 18, which is controlled by crown 12 rewinds and/or resets the movement. The first and second control members 20 and 22 are thus arranged on either side of time-setting stem 18 and each have an angular shift $\alpha$ of less than 90° with said stem in relation to the centre of the movement, typically an angular shift of the order of 30°. This angular shift $\alpha$ is the standard angular shift of commercially available watch movements, such as those sold for example by ETA SA Manufacture Horlogère Suisse under the name cal. 251. It should thus be noted that time-setting stem 18 and the first and second control members 20 and 22 are arranged in a first peripheral area of the movement, whereas push-buttons 14 and 16 are arranged in a second peripheral area of the movement, such that each of push-buttons 14 and 16 and stem 18 have between them, in relation to the centre of the movement, an angular shift greater than 90°, typically of the order of 150°. Time-setting stem 18 and first and second control members 20, 22, are located on one side of the 12 o'clock—6 o'clock axis and push-buttons 14 and 16 are on the other side.

According to the invention, push-buttons 14 and 16 form part of a device for actuating first and second control members 20 and 22, which is independent of the watch movement. This actuation device further includes a movement transmission mechanism 24 which extends between push-button 14 and first control member 20, on the one hand, and between push-button 16 and second control member 22, on the other hand. In the example shown, transmission mechanism 24 is a hinged mechanism carried by casing ring 10. It goes without saying that according to an alternative embodiment mechanism 24 could be directly mounted inside middle part 8.

The transmission mechanism 24 visible in FIGS. 2 and 3 includes a first lever 26 pivoting about a first pin 28 arranged in the area of time-setting stem 18 between the movement and an inner wall of middle part 8. In this example, the first pin 28 is mounted on the lower surface of casing ring 10, for example driven therein. It will be noted in this regard that lever 26 extends into an area located below stem 18, in relation to the watch dial, to avoid interfering with the operation of the stem. The first lever 26 includes a first arm 26*a* and a second arm 26*b* which extend respectively on either side of its pivoting pin 28. It will also be noted that lever 26 has a first bent median zone which substantially matches the external shape of the movement. Arms 26*a* and 26*b* are each provided with a protruding portion 30*a*, 30*b*, the latter being respectively oriented in the direction of control members 22, 20 of the movement, in this case in the direction of the centre of movement 4. The free end of first arm 26*a* is hinged to one end of a stem 32, the other end of which is hinged to a second lever 3. Lever 34 pivots about a second pin 36 arranged in the area of push-buttons 14 and 16 between the movement and an inner wall of middle part 8. Lever 34 is also mounted on casing ring 10 in an identical manner to first lever 26. Lever 34 includes a first arm 34*a* and a second arm 34*b* which extend respectively on either side of second pin 36. Lever 34 includes a first arm 34*a* and a second arm 34*b* which extend respectively on either side of its pivoting pin 36. lever 34 also has a bent median zone which substantially matches the external shape of the movement. Arms 34*a* and 34*b* are each provided with a support surface 38*a*, 38*b*, the latter being respectively oriented in the direction of stems 14*a* and 16*a* of push-buttons 14 and 16. Transmission mechanism 24 further includes a second pin 40 hinged on the free end of second arm 26*b* of first lever 26 and on the free end of second arm 34*b* of second lever 34. It will be noted in this regard that stems 32 and 40 each have in a median zone, a bent profile substantially matching the peripheral contour of the movement, which limits the size of the transmission mechanism inside the case.

The two levers 26 and 34 and the two hinged pins 32 and 40 thus together form a parallelogram that can be deformed via the action of push-buttons 14 and 16 and which activates control members 20 and 22 located in an opposite layout to the push-buttons for controlling said members. Thus, when for example, push-button 16 is pressed, its stem 16*a* acts on support surface 38*b* of lever 34 which then tips around its pin 36 in the direction of arrow $F_1$ (FIG. 3). In doing this, arm 34 pushes stem 40 in the direction of arrow $F_2$ which in turn tips lever 26 around its pin 28 in the direction of arrow $F_3$ thus actuating control member 22 via protruding portion 30*a*. The same principle applies when push-button 14 is pressed in order to activate control member 20, levers 26 and 43 respectively tipping in opposite directions to arrows $F_1$ and $F_3$.

The invention thus typically enables a conventional watch movement to be used, for example a chronograph movement, wherein all of the function control members are in the same peripheral area of the movement, to make a watch wherein part of the actuators associated with the control members are arranged in a first area of the watchcase and another part of the actuators associated with said members are arranged in a second area of the case, far from the first area.

It will be noted finally that the transmission mechanism further includes means 42*a* and 42*b* for returning levers 26 and 34 to their rest position shown in FIG. 2 and wherein the control members 20 and 22 are not actuated. In the example illustrated, return means 42*a* act on arm 26*a* of lever 26, whereas return means 42*b* act on arm 26*b* of said lever. Return means 42*a* and 42*b* are typically each formed of a helical spring extending between the middle part and the arm of the lever with which it is associated. It will be noted that return means 42*a* and 42*b* are each arranged at an equal distance from the pivoting pin 28 in order to ensure a position of equilibrium in the absence of any external stress on push-buttons 14 or 16.

The invention is of course not limited to the embodiment described hereinbefore and it will be understood that various alterations and/or improvements evident to those skilled in the art could be made without departing from the scope of the invention defined by the annexed claims. In particular, the crown could be arranged conventionally at 3 o'clock and the push-buttons controlling the chronograph functions could be arranged respectively at 8 o'clock and 10 o'clock. This geometrical configuration would have the advantage of maintaining the conventional orientation of the movement in the case while providing a watch with an original aesthetic appeal. One could also envisage a variant that omits one of stems 32 or 40 without affecting the operation of transmission mechanism 24 as it is shown in the Figures. In another variant, lever 34 could be omitted and push-buttons 14 and

16 could directly act respectively on stems 32 and 40, which would preferably be guided in translation by appropriate means. In yet another variant, stems 32 and 40 could be omitted provided that stems 14*a* and 16*a* of push-buttons 14 and 16 are sized and shaped to act respectively directly on arms 26*a* and 26*b*. Although the invention has been described in conjunction with the use of a chronograph movement, it is, however, clear that it can be used with any other movement including at least two control members implanted in a peripheral area of the movement.

The invention claimed is:

1. A watch including a case having a middle part and housing a watch movement having in a first peripheral area a time-setting stem, said movement further including a first and a second control member which are arranged on either side of the time-setting stem and which each have an angular shift of less than 90° with the time-setting stem in relation to the center of the movement, the watch further including an activation device including a first and a second push-button arranged on the case in proximity to the movement, for respectively actuating said first and second control members, wherein there is an angular shift greater than 90° in relation to the center of the movement, between each of said first and second push-buttons and said time-setting stem, wherein said first and second push-buttons are arranged in a second peripheral region of said watch movement said second peripheral region being opposite said first region with respect to the center of the movement and, wherein said actuation device further includes a transmission mechanism extending between said first push-button and said first control member, on the one hand, and between said second push-button and said second control member on the other hand.

2. The watch according to claim 1 further including a casing ring extending around said watch movement, wherein said transmission movement is carried by said casing ring.

3. The watch according to claim 2, wherein said transmission mechanism is a hinged mechanism.

4. The watch according to claim 1, wherein said transmission mechanism is a hinged mechanism.

5. The watch according to claim 4, wherein said hinged mechanism includes a first lever pivoting about a first pin arranged in said first peripheral region, said first lever including a first arm and a second arm respectively extending on either side of said first pin, said first push-button cooperating at least indirectly with said first arm to activate, via the second arm, at least indirectly, said first control member, in that said hinged mechanism includes a second lever pivoting about a second pin arranged in said second peripheral regions, said second lever including a first arm and a second arm extending respectively on either side of said second pin, and a first stem hinged to said first arm of said second lever and to said first arm of said first lever and wherein said second push-button cooperates with said second arm of said second lever to actuate, via said first arm of said first lever, at least indirectly, said second control member.

6. The watch according to claim 5, wherein the transmission mechanism further includes a second stem hinged to said second arm of said first lever and to said second arm of said second lever.

7. The watch according to claim 6, wherein the transmission mechanism further includes return means for returning said first lever to a rest position, in which said first and second control members are not actuated.

8. The watch according to claim 5, wherein the transmission mechanism further includes return means for returning said first lever to a rest position, in which said first and second control members are not actuated.

9. The watch according to claim 1 including a scale of 12 hours on the dial thereof, wherein the time-setting stem, the first and second control members and the first and second push-buttons are respectively located on either side of the 12 o'clock 6 o'clock axis.

10. The watch according to claim 9, wherein the first control member is arranged substantially at 8 o'clock, in that the time-setting stem is arranged substantially at 9 o'clock and is associated with a crown accessible from outside the middle part, wherein the second control member is arranged substantially at 10 o'clock, in that the first push-button actuating the first control member is arranged substantially at 2 o'clock and wherein the second push-button actuating the third control member is arranged substantially at 4 o'clock.

11. The watch according to claim 10, wherein said movement is an electronic chronograph movement, wherein said first control member activates the chronograph start and stop function, wherein the second control member activates the zero reset function of said chronograph and wherein said movement is mounted in said case such that said time-setting stem is arranged at 9 o'clock.

* * * * *